United States Patent [19]

Cooley

[11] Patent Number: 4,945,693

[45] Date of Patent: Aug. 7, 1990

[54] CONCENTRIC DOME ENERGY GENERATING BUILDING ENCLOSURE

[76] Inventor: Warren L. Cooley, P.O. Box 2392 1111 H. St., Davis, Calif. 95616

[21] Appl. No.: 321,581

[22] Filed: Mar. 10, 1989

[51] Int. Cl.[5] ..... E04B 1/32

[52] U.S. Cl. ..... 52/81; 290/55; 60/641.12; 60/641.14

[58] Field of Search ..... 52/80, 81, 82; 290/52, 290/54, 55; 60/641.12, 641.14

[56] References Cited

U.S. PATENT DOCUMENTS

| | | | |
|---|---|---|---|
| 2,682,235 | 12/1954 | Fuller | 52/81 |
| 2,914,074 | 2/1962 | Fuller | 52/81 |
| 3,063,521 | 4/1967 | Fuller | 52/81 |
| 3,949,732 | 4/1976 | Reines | 52/82 |
| 4,049,195 | 9/1977 | Ragenstein | 52/81 |
| 4,099,352 | 7/1978 | Clark | 52/80 |
| 4,118,636 | 7/1978 | Christian | 60/641.12 |
| 4,228,788 | 10/1980 | Moeser | 52/80 |
| 4,299,066 | 11/1981 | Thompson | 52/81 |
| 4,426,814 | 1/1984 | Stuhmer | 52/82 |
| 4,433,544 | 1/1984 | Wells | 60/641.12 |
| 4,680,901 | 7/1987 | Armitage | 52/81 |
| 4,757,650 | 9/1988 | Berger | 52/81 |

OTHER PUBLICATIONS

R. Buckminster Fuller, *Critical Path*, 1983, pp. 209–212.

*Primary Examiner*—Henry E. Raduazo
*Attorney, Agent, or Firm*—James M. Ritchey

[57] ABSTRACT

This invention the concentric dome energy generating building enclosure makes possible the passive transfer of renewable energy from the wind and the sun into mechanical and/or electrical energy. This invention provides the means for moving thermal and/or pneumatic pressure differentials created by the action of ambient energy on the dome through a conduit (32) between concentric dome walls and directing these air pressure differentials through a turbine (26) at the apex of the dome building enclosure causing the turbine to rotate thereby generating power which can be used to operate tools and equipment inside the building enclosure.

9 Claims, 2 Drawing Sheets

CONCENTRIC DOME ENERGY GENERATING BUILDING ENCLOSURE

BACKGROUND—FIELD OF INVENTION

This invention relates to dome building enclosures, specifically a new additional use for dome building enclosures as a means of generating energy.

BACKGROUND—CROSS REFERENCE TO RELATED APPLICATIONS

This invention introduces a new use for the dome building enclosure. The basis of this invention is drawn from the inspiration and work of Dr. R. Buckminister Fuller. Embodiments of my invention are related but not limited to the following Patents: Geodesic Dome, U.S. Pat. No. 2,682,235, 29 June 1954, Tensile-Integrity Structure, U.S. Pat. No. 3,063,521, 28 Nov. 1967, Geodesic Tent, U.S. Pat. No. 2,914,074, 13 Nov. 1962.

BACKGROUND—DISCUSSION OF PRIOR ART

Heretofore dome building enclosures have been used to meet a wide variety of requirements for enclosing a volume of space to protect humans, animals, plant and artifacts from environmental conditions. Dome building enclosures have the unique feature of providing a clear span interior space. Dome building enclosures that incorporate the principles of construction commonly referred to as geodesic or tensegrity have the unique feature of being adaptable to any size and theoreticially can be engineered to enclose unlimited volumes of space. As an additional feature of this particular class of dome construction geodesic and tensegrity domes rely on the tensile strength of the materials of construction as the major component of strength in the dome structure. Therefore these domes can successfully be construction of very light-weight woods, metals, plastics and/or fiberglasses the ratio of material to strength of the construction makes geodesic and tensegrity domes extremely materials efficient. As a class of building enclosure domes are extremely energy efficient primarily as a function of the favorable ratio of the volume space enclosed to the amount of surface area exposed to the environment to which heat is lost or gained. My invention incorporates all of the above mentioned advantages of dome building enclosures and any others which have not been mentioned specifically herein. In addition my invention makes possible the use of dome building enclosures of a specific design as an energy generating apparatus.

OBJECTS AND ADVANTAGES

An object of my invention is the use of the structural components of a shelter as a means of generating mechanical or electrical energy to power those activities, processes, tools, or appliances operating inside or adjacent the shelter.

Accordingly several objects of my invention flow directly from the advantages inherent in geodesic and/or tensegrity construction of dome building enclosures. The energy transformation that results from this invention can be described as a transformation of the unfocused ambient energy of the sun and wind into directable mechanical or electrical energy. The amount of energy that can be subjected to this transformation is directly related to the size of the surface area of the dome building enclosure exposed to the ambient energy environment. Therefore the easily variable and theoretically unlimited size features of geodesic and/or tensegrity dome building construction bears directly on the amount of energy that can be transformed into usable mechanical and/or electrical power. Structures can be tailored to generate the amount of energy required for operations and functions that take place inside the structure by manipulating the size of the construction.

An additional object of my invention is that as a human habitat or other shelter which requires precise temperature control my invention builds on the already existing energy efficient features of dome structures previously mentioned. In conventional buildings and dome structures additional energy is required in order to stabilize temperature control in a precise comfort zones. My invention, producing electrical energy to be used for this additional temperature regulation, has the advantage of producing this energy for utilization in a naturally energy conserving structure.

A relate object of this invention allows for a greatly reduced cooling load with respect to a conventional dome building enclosures. The exhaust and transfer of the normal incidence of solar gain by means of a concentric conduit and turbine into electrical or mechanical power reduces the internal cooling load. Therefore this invention will function in all aspects of peak efficiency in very hot environments. In addition and as is the case in many local environments winds acting on the structure to produce energy may be mild or becalmed during the warmest parts of the day, but increase during the milder parts of the day and particularly at night. This invention has the advantage of being an optimally efficient energy generating apparatus because it is designed to take advantage of all fluctuations in the ambient energy environment from which usable power can be harvested.

An additional object of my invention is that it makes use of renewable energy sources and in doing so produces no environmental pollution or by-products.

A further and significant object of my invention is related to the synergism resulting from energy of both the sun and the wind acting on the same turbine at the same time. By virtue of reduced friction loss in the action of the turbine and related parts more usable energy can be produced then if these sources of energy operated independently on independent turbines.

Yet another object of my invention over conventional dome building enclosures is inherent in the ability of the structure to generate energy rendering it energy autonomous. This is particularly important in those situation that require shelter for humans or related human activity and that are remote to existing electrical power grids. The economics of using the components of structure which already exist as a function of its purpose to also generate power for use in the shelter eliminates or reduces redundancy of equipment that would be required to accomplish similar results and makes this invention a very cost-effective alternative to existing approaches to remote shelter and autonomous building design.

BRIEF DESCRIPTION OF THE DRAWINGS

The foregoing and other objects, features and advantages of the invention will become more fully understood from the following description of preferred embodiments of the invention as illustrated in the accompanying drawings in which like reference characters refer to the same parts throughout the different views.

The drawings are not necessarily to scale, emphasis instead being placed upon illustrating the principles of the invention.

DESCRIPTION OF PREFERRED EMBODIMENTS OF THE INVENTION

Figure 1:
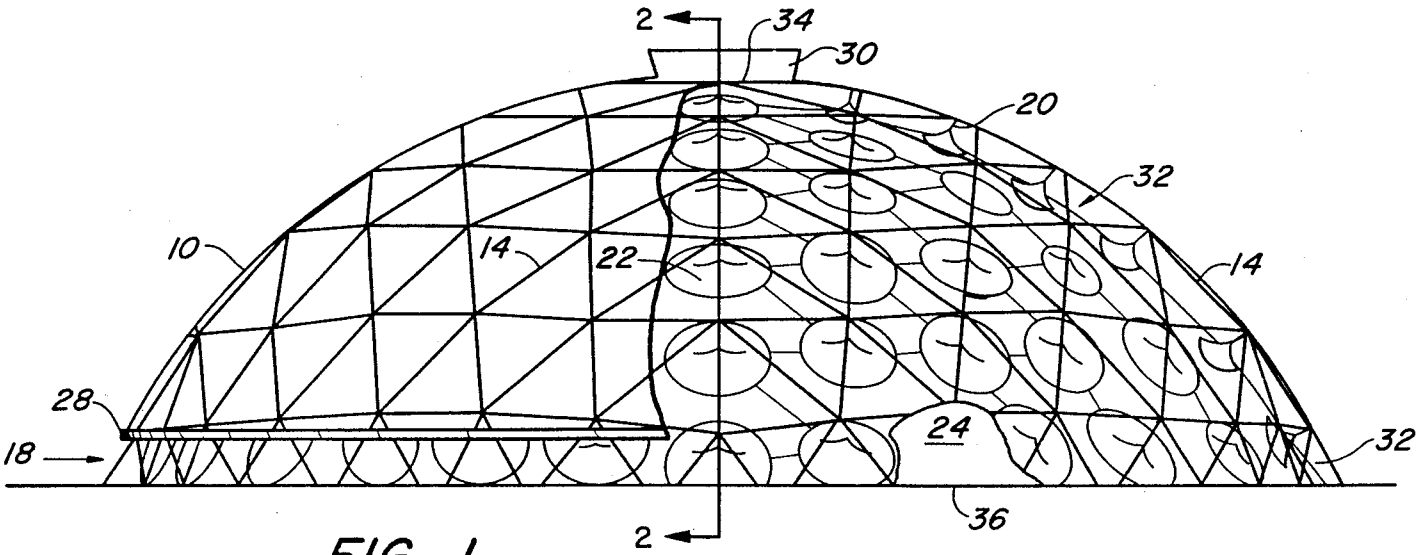
FIG. 1 is an elevation view of the preferred embodiment of this invention the concentric dome energy generating building enclosure with outer covering and gutter cut back to reveal interior.

Referring to FIG. 1 concentric dome energy generating building enclosure comprises an interior space 24 with a floor 36 below surrounded by an outer transparent dome wall 10. This embodiment of the invention is designed to be approximately the most efficient means of building the invention as a function of the total weight of the structure vs. the total volume of space enclosed.

A first flexible approximately dome shaped interior wall 22 of stratified material tailored in the manner of a geodesic tent defines interior space 24. Interior dome stratified material 22 being attached to floor 36 and suspended from a geodesic framework 14 with thermally insulated attachments 20 to form the interior wall of conduit 32 with geodesic framework 14 and transparent dome wall 10 which together form the exterior wall of the conduit 32 extending approximately around the entire circumference between concentric domes. Transparent dome wall 10 being tailored and attached to fit geodesic framework 14 in an approximately convex contour. At the apex of geodesic framework 14 and outer transparent dome wall 10 turbine cowling 30 is positioned over an opening 34 and secured to geodesic framework 14. Around the entire bottom perimeter of transparent dome wall 10 a gutter 28 is secured to geodesic framework 14 in a manner to allow for the collection of rain water at a central point and forms the lower edge of transparent dome wall 10 and the upper edge of the bottom perimeter air inlet 18 which continues approximately around the circumference of the geodesic framework 14 and terminates at floor 36.

Figure 2:
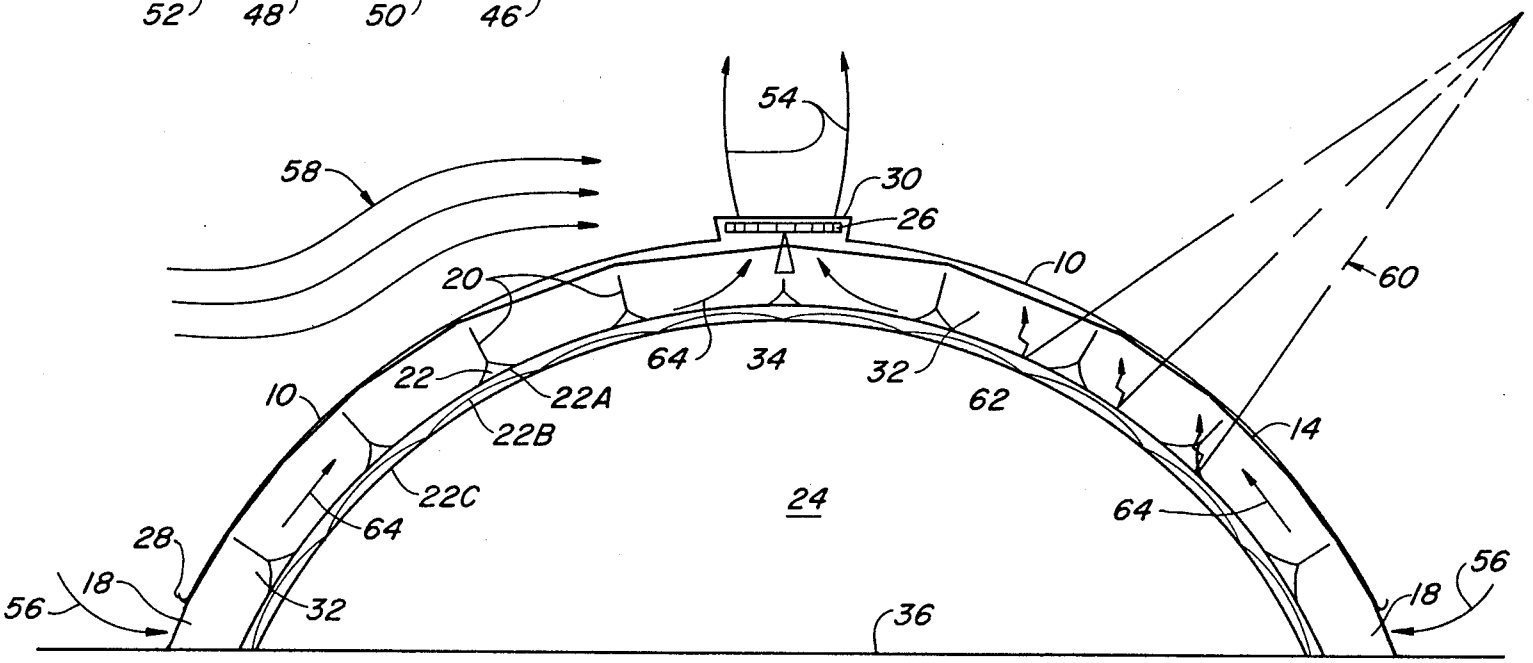
FIG.2 is a cross-sectional view divided at section line 2—2 of this invention showing the action of sun and wind energy on this invention and the movement of cycles of air pressure which cause the rotation of a turbine for the generation of energy.

Section line 2—2 divides FIG. 1 to show cross-sectional view of the invention in FIG. 2.

The operation of the concentric dome energy generating building enclosure is best understood by referring to FIG. 2. Ocurring independently and simultaneously but not necessarily at the same time sunlight 60 and the wind pressure 58 act on the concentric dome building enclosure shown in FIG. 2. The sunlight as a form of energy travels through the transparent or translucent exterior dome wall 10 and strikes the stratified material 22, of the interior dome. The stratified material 22 being specifically designed to be a good absorber of sunlight energy and emitter of heat energy, has an opaque outer layer **22*a*, an insulation middle layer 22*b*, and a double sided reflective inner layer 22*c*. The stratified layers of this material being bonded or joined together in a manner appropriate to use as a solar collector. The stratified material of interior dome wall 22 may be optionally fitted with an arrangement of a plurality of windows to allow light to pass through to the interior space 24. The sunlight having been transformed to heat energy 62 by encountering the interior wall of conduit 32 radiates into the conduit space 32 heating the air resulting in a cycle of thermal updrafts shown as arrows 64. Exhausting as shown by arrows 54 through apex opening 34 and acting on turbine 26 to produce power. The cycle of heating air in conduit 32 is continued as cooler air 56 replaces the exhaust by entering conduit 32 at bottom perimeter air inlet 18. As the wind 58, acting independent or in conjunction with the sulight 60, moves across the curved outer transparent dome wall 10 encountering this curved surface the internal air pressure near the surface drops and a corresponding higher air pressure occurs on the inside of the outer curved surface resulting in lift as in a wing or sail. This resulting high pressure being confind in the conduit 32 between the concentric dome walls moves perpendicular to the direction ofthe wind and is thereby forced upward and focused to the apex opening 34 as indicated with arrows 64 exhausting through turbine 26 as indicated with arrows 54. The exhausted air pressure 54 acting on turbine 26 to generate power. The cycle of exhausted air is replenished with air being drawn into bottom perimeter air inlets 18 as shown by arrows 56**.

Figure 3:
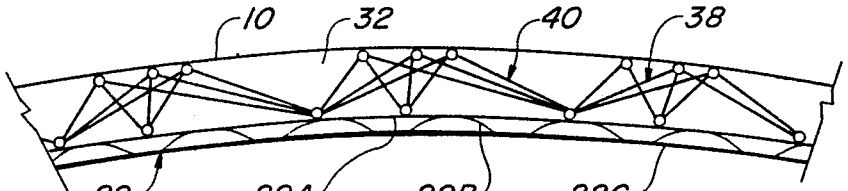
Fig. 3 is a cross-sectional view of another embodiment of the interior and exterior concentric dome elements of this invention showing an alternative means of constructing concentric dome walls by using an octet-truss framework to support the concentric walls of the conduit element of this invention.

An alternative embodiment describing the construction of the invention is represented in FIG. 3. This embodiment of the invention does not effect the operation of the invention. FIG. 3 shows a cross-sectional view of a section of the conduit 32 between the concentric dome walls. In this embodiment of the invention the outer transparent dome wall 10 and the interior dome wall 22 of conduit 32 may be fabricated of materials and attached and in approximately the same manner as in previous embodiments of the invention. The conduit 32 between concentric dome walls is supported by an arrangement of struts 38 and tendons 40 configured and joined in a pattern generally resembling an octet-truss.

Figure 4:
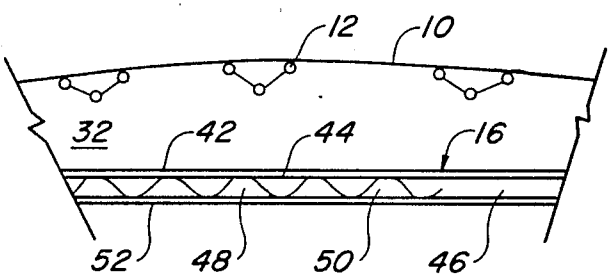
FIG.4 is a cross-sectional view of another embodiment of the interior and exterior concentric dome elements of this invention showing an alternative means of constructing this invention by using a conventional space frame geodesic dome as the interior concentric dome wall with a slightly larger tensegrity dome framework and outer convex covering as the exterior concentric dome wall.

A further embodiment of this invention is shown in FIG. 4 a cross-sectional view of a section of conduit 32. This embodiment does not effect the operation of the invention and shows an alternate form of constructing conduit 32 between concentric dome walls. The interior dome wall is formed from a geodesic space frame 16 comprising two by four wooden members sheeted with sections of plywood to form independent triangles that can be joined together to construct a free standing geodesic dome. Using standard building materials the triangles would be stratified with the outer layer being an opaque roofing material 42 attached to and covering plywood sheeting 44 attached to two by four wooden strut members 46. The cavity formed on the underside of the triangle to be fitted with insulation batt material 48 having a reflective foil backing 50 and closed on the interior side with interior wall finish sheeting 52. The exterior wall of conduit 32 is formed by a dome having a generally larger diameter then the interior dome comprising a tensegrity framework 12 constructed of wooden, plastic, fiberglass or metal struts and tendons and covered in the same manner as previous embodiments with an outer transparent dome wall 10.

While the invention has been particularly shown and described with reference to preferred embodiments thereof, it will be understood by those skilled in the art that various changes in form, details, size and materials may be made therein without departing from the spirit and scope of the invention as defined by the claims.

I claim:

1. A dome building enclosure for generating mechanical or electric energy comprising: (a) a flexible interior concentric dome wall, (b) a sunlight transparent exterior concentric dome wall surrounding and supporting, by insulated suspension attachments, said interior concentric dome wall with said exterior concentric dome wall having, an apex, and a bottom perimeter air inlet, (c) an inner space defined by said interior concentric dome wall, (d) a conduit between said concentric dome walls, (e) and a turbine positioned over an opening in said apex of said exterior concentric dome wall.

2. The dome building enclosure of claim 1 comprising said interior and exterior concentric domes supported by a framework constructed of a plurality of struts held together in tension, arranged in a geodesic pattern.

3. A power producing building enclosure comprising:

(a) a dome enclosing an interior space having a floor with said dome comprising a flexible interior dome wall suspended by thermally insulated attachments from an exterior concentric dome wall;

(b) a conduit separating said interior and exterior dome walls;

(c) means for air to enter into said conduit through said exterior dome wall;

(d) means for sunlight to enter through said exterior dome wall into said conduit; and (e) means for exhausting said air from said conduit through said exterior dome wall to produce power.

4. A power producing building enclosure comprising:

(a) a dome enclosing an interior space having a floor with said dome comprising a flexible interior dome wall suspended by thermally insulated attachments from an exterior concentric dome wall, wherein said interior dome wall comprises a stratified material having an opaque outer layer, an insulating middle layer, and a double sided reflective inner layer;

(b) a conduit separating said interior and exterior dome walls;

(c) means for air to enter into said conduit through said exterior dome wall;

(d) means for sulight to enter through said exterior dome wall into said conduit; and (e) means for exhausting said air from said conduit through said exterior dome wall to produce power.

5. A power producing building enclosure, comprising:

(a) a dome enclosing an interior space having a floor with said dome comprising a flexible interior dome wall suspended by thermally insulated attachments from an exterior concentric dome wall wherein said interior dome wall comprises a stratified material having an opaque outer layer, an insulating middle layer, and a double sided reflective inner layer and said exterior dome wall is sunlight transparent;

(b) a conduit separating said interior and exterior dome walls, wherein said conduit extends approximately around the entire circumference between said concentric dome walls;

(c) means for air to enter into said conduit through said exterior dome wall wherein said air entry means comprises a bottom perimeter air inlet in said exterior dome wall; and (d) means for exhausting said air from said conduit through said exterior dome wall to produce power wherein said exhausting means comprises a turbine positioned over an opening in the apex of said exterior dome wall.

6. A method of producing power, comprising the steps:

(a) constructing a dome building enclosure comprising:

a dome enclosing an interior space having a floor with said dome comprising an interior dome wall and an exterior concentric dome wall wherein said interior dome wall comprises a stratified material having an opaque outer layer, an insulating middle layer, and a double sided reflective inner layer and said exterior dome wall is sunlight transparent and a conduit separating said interior and exterior dome walls;

(b) equipping said dome building enclosure with means for air to enter into said conduit through said exterior dome wall wherein said air entry means comprises a bottom perimeter air inlet in said exterior dome wall;

(c) positioning said enclosure so that the wind moves across the curved surface of said exterior dome wall thereby generating lift pressure on said air within said conduit; and (d) providing said dome building enclosure with means for exhausting said lift pressurized air from said conduit through said exterior dome wall to produce power wherein said exhausting means comprises a turbine positioned over an opening in the apex of said exterior dome wall.

7. A method of producing power according to claim 6, further comprising the step of locating said enclosure so that sunlight passes through said exterior dome wall and srikes said interior dome wall thereby heating said conduit air.

8. A method of producing power according to claim 6, wherein said interior dome wall is suspended by thermally insulated attachements from said exterior dome wall.

9. A method of producing power according to claim 6, wherein said interior dome wall is flexible.

* * * * *